US012025369B2

(12) United States Patent
Middleton

(10) Patent No.: US 12,025,369 B2
(45) Date of Patent: Jul. 2, 2024

(54) PRESSURE RELEASE TECHNOLOGY FOR HARD-SIDED COOLER BOXES

(71) Applicant: Academy, Ltd., Katy, TX (US)

(72) Inventor: Michael Middleton, Katy, TX (US)

(73) Assignee: Academy, Ltd., Katy, TX (US)

( * ) Notice: Subject to any disclaimer, the term of this patent is extended or adjusted under 35 U.S.C. 154(b) by 157 days.

(21) Appl. No.: 17/304,767

(22) Filed: Jun. 25, 2021

(65) Prior Publication Data

US 2022/0412632 A1 Dec. 29, 2022

(51) Int. Cl.

| | |
|---|---|
| ***B65D 81/38*** | (2006.01) |
| ***A45C 11/20*** | (2006.01) |
| ***B65D 43/16*** | (2006.01) |
| ***B65D 45/24*** | (2006.01) |
| ***B65D 51/16*** | (2006.01) |
| ***F25D 3/08*** | (2006.01) |
| ***F25D 23/02*** | (2006.01) |
| *B65D 25/32* | (2006.01) |
| *F25D 23/06* | (2006.01) |

(52) U.S. Cl.

CPC ..... *F25D 3/08* (2013.01); *A45C 11/20* (2013.01); *B65D 43/163* (2013.01); *B65D 45/24* (2013.01); *B65D 51/1683* (2013.01); *B65D 81/38* (2013.01); *B65D 81/3823* (2013.01); *F25D 23/028* (2013.01); *B65D 25/32* (2013.01); *B65D 2543/00194* (2013.01); *B65D 2543/00296* (2013.01); *F25D 23/066* (2013.01); *F25D 2201/126* (2013.01); *F25D 2300/00* (2013.01); *F25D 2331/804* (2013.01)

(58) Field of Classification Search

CPC ..... A45C 11/20; B65D 25/32; B65D 2543/00194; B65D 2543/00296; B65D 2543/00314; B65D 2543/00972; B65D 43/163; B65D 45/24; B65D 51/16; B65D 51/1683; B65D 81/3823; F25D 17/047; F25D 2201/126; F25D 23/028; F25D 23/066; F25D 2300/00; F25D 2331/804; F25D 3/08

USPC ..... 220/315, 592.2, 592.26, 817, 819, 826, 220/845; 229/125.23

See application file for complete search history.

(56) References Cited

U.S. PATENT DOCUMENTS

| | | | | |
|---|---|---|---|---|
| 4,143,695 | A * | 3/1979 | Hoehn | A45C 11/20 220/837 |
| 6,789,692 | B2 * | 9/2004 | Prezelin | B65D 45/20 220/360 |
| 7,310,967 | B2 | 12/2007 | Aragon | |
| 8,875,934 | B2 | 11/2014 | Deka | |
| 9,668,510 | B2 | 12/2017 | Doman | |
| 10,247,468 | B2 | 4/2019 | Hiemeyer et al. | |

(Continued)

*Primary Examiner* — John K Fristoe, Jr.
*Assistant Examiner* — Madison L Poos
(74) *Attorney, Agent, or Firm* — KLEMCHUK PLLC

(57) ABSTRACT

A hard-sided cooler box may include a channel or cylindrical-shaped hole that extends from the outside of the cooler box to the inside of the cooler box. This cylindrical-shaped hole or channel may be covered/sealed by one or more latches of the cooler box when the cooler box is closed, and the latches are secured. However, when the latches of the cooler box are released, the cylindrical-shaped hole or channel may be unblocked, and the air from the interior of the cooler box can escape to the outside of the cooler box before the lid is lifted from the body. This allows the lid to be opened with no struggle.

20 Claims, 9 Drawing Sheets

(56) References Cited

U.S. PATENT DOCUMENTS

| | | | | |
|---|---|---|---|---|
| 10,464,734 | B2 | 11/2019 | Wooldridge et al. | |
| 10,486,887 | B2 | 11/2019 | Wooldridge et al. | |
| 10,486,888 | B2 | 11/2019 | Wooldridge et al. | |
| 10,538,365 | B2 | 1/2020 | Wood | |
| 10,640,278 | B2 | 5/2020 | Niemeyer et al. | |
| 10,676,267 | B2 | 6/2020 | Seiders et al. | |
| 2004/0178202 | A1* | 9/2004 | Serio, Jr. | A45C 13/008 220/324 |
| 2014/0319147 | A1* | 10/2014 | Horovitz | B65D 43/163 220/845 |
| 2019/0152677 | A1* | 5/2019 | Hoyt | B65D 81/3818 |
| 2019/0234671 | A1* | 8/2019 | Stanford | B65D 81/3811 |

* cited by examiner

PRESSURE RELEASE TECHNOLOGY FOR HARD-SIDED COOLER BOXES

FIELD OF THE DISCLOSURE

The present disclosure generally relates to hard-sided cooler boxes, and more particularly to pressure release technology for hard-sided cooler boxes.

BACKGROUND

Pressure often builds up in hard-sided cooler boxes. Users of these hard-sided cooler boxes typically remove the drain plug in order to release the built-up pressure. However, this often results in losing ice and water stored within the hard-sided cooler box. In addition, removing the drain plug can be cumbersome to execute each time that the hard-sided cooler box is opened. A vacuum release button also may be utilized, but this is a physical button that still requires the user to affirmatively push the button to release the pressure each time that the hard-sided cooler box is opened.

SUMMARY

Embodiments of the present disclosure may provide a hard-sided cooler box comprising: a body formed of a bottom, a front wall parallel to a back wall, a first side wall parallel to a second side wall, the front wall, the back wall, the first side wall, and the second side wall extending from the bottom to delineate the body of the hard-sided cooler box; a lid coupled to an opening of the body opposite the bottom of the body, the lid movable between an open position and a closed position; at least one receiver positioned on an outer portion of the front wall, the at least one receiver having a channel that may extend from the outer portion of the front wall through the body of the hard-sided cooler box; and at least one latch securable to the at least one receiver, wherein the at least one latch may cover the channel when the lid is in a closed position and the at least one latch is secured, and wherein the channel may be unblocked to release pressure from the body of the hard-sided cooler box when the at least one latch is unsecured. The channel may extend through the body, an insulation foam, and a liner of the hard-sided cooler box. The lid may be a one-sided opening lid or a dual-sided opening lid. The at least one latch may comprise a first latch securable to a first receiver positioned on the outer portion of the front wall; and a second latch securable to a second receiver positioned on an outer portion of the back wall, wherein the first receiver and the second receiver each house a channel covered by the first latch and the second latch, respectively, when the lid is in a closed position and the first latch and the second latch are secured, and wherein each of the channels is unblocked to release pressure from the body of the hard-sided cooler box when the first latch and the second latch are unsecured. The at least one latch may provide a smooth, flat surface that connects flush with the at least one receiver. When the at least one latch is secured to the at least one receiver, a seal may be created, and when the at least one latch is released, air contained within the body may be released through the channel. The cooler box may further comprise at least one additional latch that is securable to the front wall of the hard-sided cooler box but does not cover the channel.

Other embodiments of the present disclosure may provide a hard-sided cooler box comprising: a body formed of a bottom, a front wall parallel to a back wall, a first side wall parallel to a second side wall, the front wall, the back wall, the first side wall, and the second side wall extending from the bottom to delineate the body of the hard-sided cooler box; a dual-sided opening lid coupled to an opening of the body opposite the bottom of the body, the lid movable between an open position and a closed position; a first latch securable to a first receiver positioned on the outer portion of the front wall; and a second latch securable to a second receiver positioned on an outer portion of the back wall, wherein the first receiver and the second receiver each may house a channel covered by the first latch and the second latch, respectively, when the lid is in a closed position and the first latch and the second latch are secured, and wherein each of the channels may be unblocked to release pressure from the body of the hard-sided cooler box when the at least the first latch or the second latch is unsecured. The first latch and the second latch may both be unsecured to release pressure from the channels on the first receiver and the second receiver. Each of the channels may extend through the body, an insulation foam, and a liner of the hard-sided cooler box. The first latch and the second latch each may provide a smooth, flat surface that connects flush with the first receiver and the second receiver, respectively. When the first latch and the second latch are secured to the first receiver and the second receiver, respectively, a seal may be created, and when the at least the first latch or the second latch is released, air contained within the body may be released through the channel. The cooler box also may include at least one additional latch that is securable to the front wall of the hard-sided cooler box but does not cover a channel. The first latch and the second latch may be attached to the lid when unsecured or they may be attached to the front wall and the back wall of the hard-sided cooler box when unsecured.

Further embodiments of the present disclosure may provide a hard-sided cooler box comprising: a body formed of a bottom, a front wall parallel to a back wall, a first side wall parallel to a second side wall, the front wall, the back wall, the first side wall, and the second side wall extending from the bottom to delineate the body of the hard-sided cooler box; a lid coupled to an opening of the body opposite the bottom of the body, the lid movable between an open position and a closed position; a first receiver positioned on an outer portion of the front wall, the receiver having a channel that may extend from the outer portion of the front wall through the body of the hard-sided cooler box; and a first latch securable to the first receiver, wherein the first latch may cover the channel when the lid is in a closed position and the first latch is secured, and wherein the channel is unblocked to release pressure from the body of the hard-sided cooler box when the first latch is unsecured. The cooler box also may include a second latch securable to a second receiver not including a channel. The channel may extend through the body, an insulation foam, and a liner of the hard-sided cooler box. The first latch may provide a smooth, flat surface that connects flush with the first receiver.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a hard-sided cooler box having a channel or cylindrical-shaped hole that may extend from the outside of the cooler box to the inside of the cooler box. More specifically, the channel or cylindrical-shaped hole may begin at a position on a front outer wall of the hard-sided cooler box. The channel or cylindrical-shaped hole may extend from a front outer wall of the hard-sided cooler box through the cooler body, the insulation foam, and the inner wall (liner).

The hard-sided cooler box according to embodiments of the present disclosure may include at least one latch that may secure to the front outer wall of the hard-sided cooler box. The at least one latch may be configured to provide a smooth, flat surface so that it may connect flush with the portion (which also may be referred to herein as a receiver) of the front outer wall of the hard-sided cooler box where the channel or cylindrical-shaped hole may originate. When the lid of the hard-sided cooler box to which the at least one latch may be attached is closed, the at least one latch in connection with the channel or cylindrical-shaped hole on the front outer wall of the hard-sided cooler box may create a seal to keep air or external conditions from affecting the contents of the hard-sided cooler box. When at least one latch of the hard-sided cooler box according to embodiments of the present disclosure is released, the channel or cylindrical-shaped hole may be unblocked. Accordingly, air that has been contained with the interior of the hard-sided cooler box may escape to the outside of the hard-sided cooler box before the lid is entirely lifted from the body of the hard-sided cooler box that may be dual-sided or the lid is opened to be at an angle relative to the body of the hard-sided cooler box. This may allow the lid to opened by a user more easily (i.e., with less struggle). This is because the pressure that may build up inside the hard-sided cooler box when it is in a closed configuration may be released through the channel or cylindrical-shaped hole that is exposed to the exterior of the hard-sided cooler box when the latch covering it is released. As depicted herein, it should be appreciated that the pressure release technology may be used with lids of hard-sided cooler boxes that may open on one side or may be dual-side opening in embodiments of the present disclosure.

Figure 1:
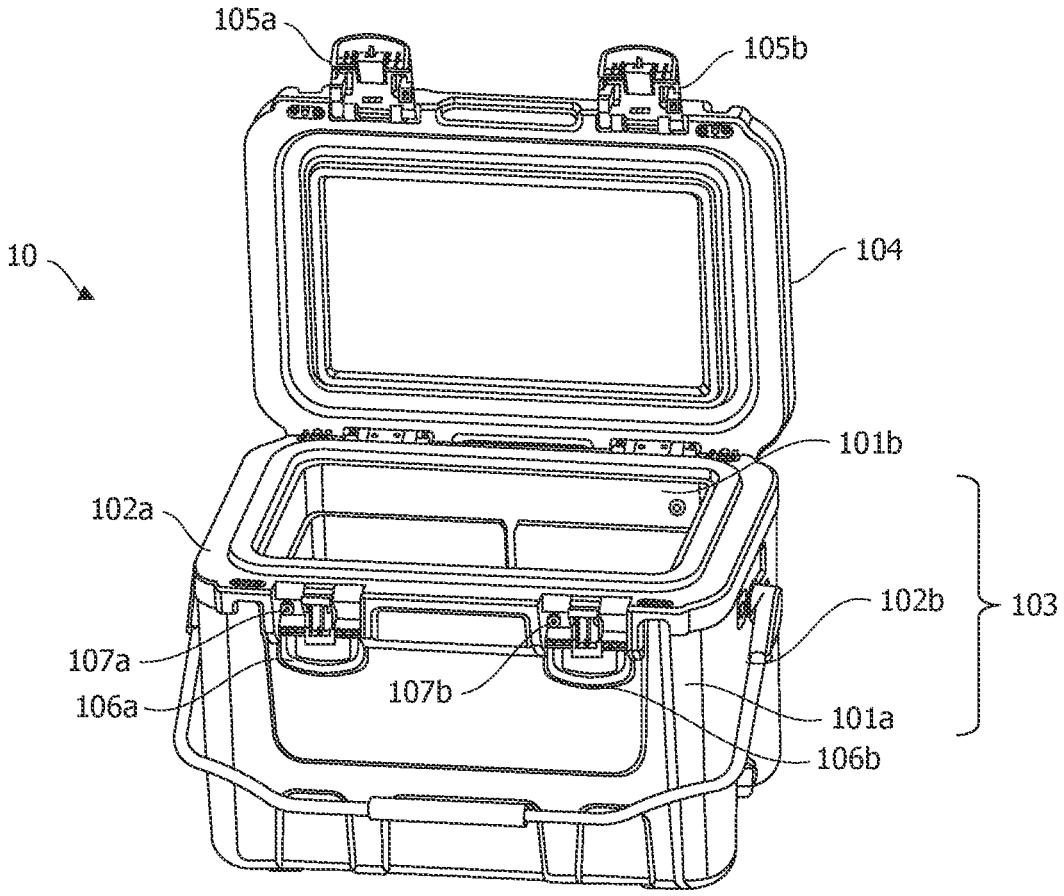
FIG. 1 depicts a hard-sided cooler in an open configuration and including a one-sided opening lid according to an embodiment of the present disclosure.

FIG. 1 depicts hard-sided cooler box 10 in an open configuration and including one-sided opening lid 104 according to an embodiment of the present disclosure. Hard-sided cooler box 10 may include front wall 101*a* and back wall 101*b* that may be positioned parallel to one another and side walls 102*a*, 102*b* that may be positioned parallel to one another. Front wall 101*a*, back wall 101*b*, and side walls 102*a*, 102*b* may be connected to form cooler body 103 that may receive one or more items to be cooled. Each of front wall 101*a*, back wall 101*b*, and side walls 102*a*, 102*b* may include an outer hard wall, insulation foam, and an inner wall facing cooler body 103.

Cooler box 10 may include lid 104 in embodiments of the present disclosure. When cooler box 10 is closed, lid 104 and front wall 101*a*, back wall 101*b*, and side walls 102*a* along with the bottom wall (not depicted herein) of cooler box 10 may enclose cooler body 103 which may provide storage for one or more items to be cooled.

Lid 104 may include one or more latches 105*a*, 105*b*. One or more latches 105*a*, 105*b* may be used to attach lid 104 to front wall 101*a* and close cooler box 10. In addition, one or more latches 105*a*, 105*b* may seal cooler box 10 while still allowing cooler box 10 to be easily opened without excessive pressure build-up within cooler box 10. One or more latches 105*a*, 105*b* may connect to receivers 106*a*, 106*b* that may be provided on front wall 101*a*. As depicted herein, latch 105*a* may have a smooth, flat surface so that it may connect flush with receiver 106*a* where channel or cylindrical-shaped hole 107*a* may originate, and latch 105*b* may have a smooth, flat surface so that it may connect flush with receiver 106*b* where channel or cylindrical-shaped hole 107*b* may originate. When lid 104 of hard-sided cooler box 10 to which latches 105*a*, 105*b* may be attached is closed (i.e., affixed to receivers on the wall(s) of cooler box 10), latches 105*a* and 105*b* may create a seal over channel or cylindrical-shaped holes 107*a* and 107*b* to keep air or external conditions from affecting the contents of hard-sided cooler box 10. When latches 105*a*, 105*b* are released, channel or cylindrical-shaped holes 107*a*, 107*b* may be unblocked, allowing air/pressure to be released from cooler box 10.

Figure 2A:
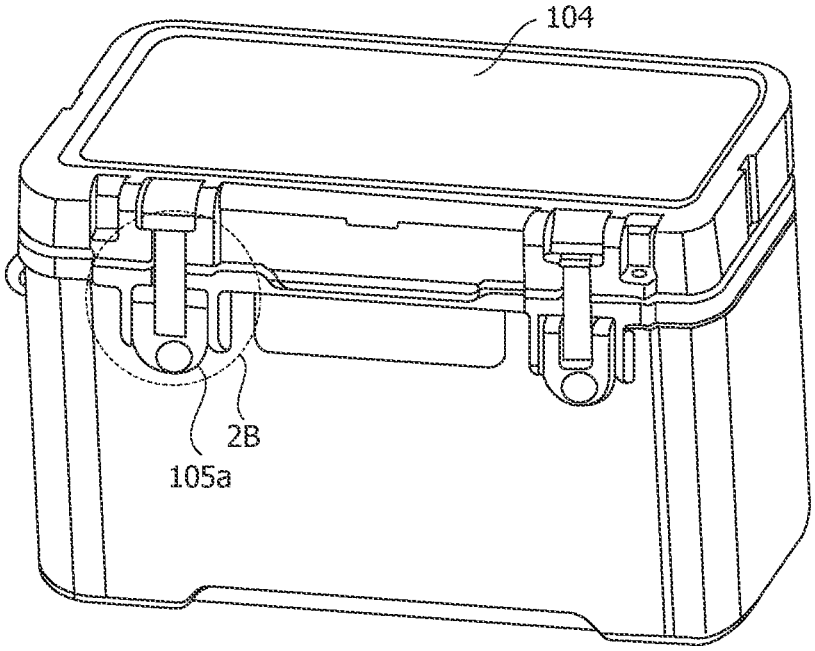
FIG. 2A depicts a hard-sided cooler in a closed configuration with a one-sided opening lid according to an embodiment of the present disclosure.
Figure 2B:
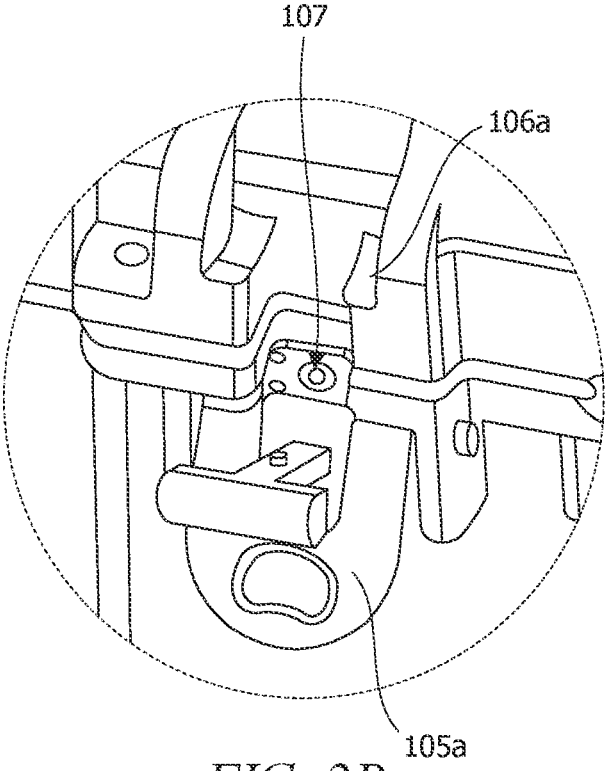
FIG. 2B depicts a close-up view of a latch on the hard-sided cooler of FIG. 2A in an open position according to an embodiment of the present disclosure.

FIG. 2A depicts a hard-sided cooler box in a closed configuration with a one-sided opening lid according to an embodiment of the present disclosure. FIG. 2B depicts a close-up view of a latch of the hard-sided cooler box of FIG. 2A in an open position according to an embodiment of the present disclosure. As depicted in FIG. 2B, when lid 104 is closed but before latch 105*a* is secured, channel or cylindrical-shaped hole 107 present on receiver 106*a* may be visible. However, when latch 105*a* is secured to receiver 106*a*, latch 105*a* would now covering channel or cylindrical-shaped hole 107 such that the hard-sided cooler box is sealed, and the contents of the hard-sided cooler box would not be exposed to outside air or external conditions until latch 105*a* is later released. When latch 105*a* is released, pressure may be released through channel or cylindrical-shaped hole 107 being no longer blocked by latch 105*a*. Accordingly, lid 104 may be opened by a user more easily because the user is no longer fighting against the pressure built up inside the body of the cooler box when air/pressure escapes through unblocked channel or cylindrical-shaped hole 107.

Figure 3A:
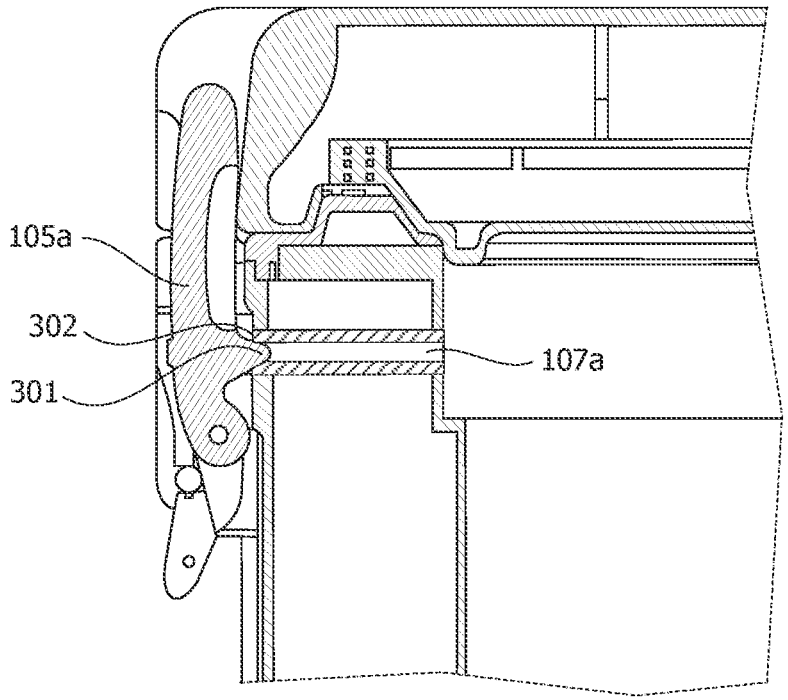
FIG. 3A depicts a side cross-sectional view of a latch on a hard-sided cooler with a one-sided opening lid in a closed position according to an embodiment of the present disclosure.
Figure 3B:
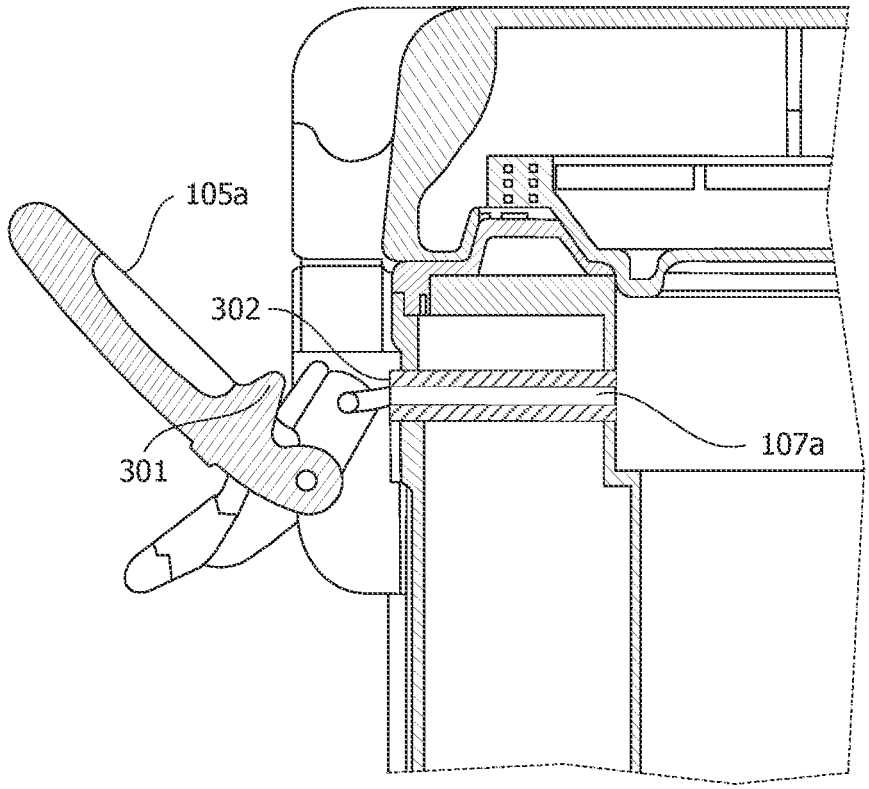
FIG. 3B depicts a side cross-sectional view of a latch on a hard-sided cooler with a one-sided opening lid in an open position according to an embodiment of the present disclosure.

FIG. 3A depicts a side cross-sectional view of latch 105*a* on a hard-sided cooler box with a one-sided opening lid in a closed position according to an embodiment of the present disclosure. As depicted herein, channel or cylindrical-shaped hole 107*a* may be blocked by blocking member 301 of the latch 105*a*, through the closure of latch 105*a*. The closure of latch 105*a* would not affect the effectiveness of cooling of the hard-sided cooler box because channel or cylindrical-shaped hole 107*a* is not open to external conditions since the channel or cylindrical-shaped hole 107*a* is blocked by blocking member 301. As can be seen, the blocking member 301 directly covers the channel or cylindrical-shaped hole 107*a*. The blocking member 301 can be formed as a protrusion that blocks then end 302 of the channel or cylindrical-shaped hole 107*a* and extends into the end 302 of the channel or cylindrical-shaped hole 107*a*. The blocking member 301 can be formed integrally with the latch 105*a*, FIG. 3B depicts a side cross-sectional view of latch 105*a* on a hard-sided cooler box with a one-sided opening lid in an open position according to an embodiment of the present disclosure. When latch 105*a* is opened, channel or cylindrical-shaped hole 107*a* may be open to external conditions, allowing air pressure or vacuum to be released from the interior of the hard-sided cooler box. This blocking and unblocking of channel or cylindrical-shaped hole 107*a* may address the vacuum seal problem that arises with one-way gaskets (sometimes referred to as "v-seals") that typically seal the lid to the body of a hard-sided cooler box. These one-way gaskets allow air to escape the body of the hard-sided cooler box, such as when a user shuts the lid and secures the latches, but they do not allow air to travel from the outside into the body. This leads to vacuum pressure build-up inside the cooler box, and along with other variables, including, but not limited to, ice melting over time, atmospheric pressure changes, elevation changes, temperature outside the cooler changes, the lid can become very difficult to open even after the latches are un-done. Inclusion of channel or cylindrical-shaped hole 107*a* may address the problem of the gasket becoming vacuum-sealed to the body or walls of the hard-sided cooler box, as air/pressure may be released from the body of the hard-sided cooler box through channel or cylindrical-shaped hole 107*a* immediately upon release of latch 105*a*, and the hard-sided cooler may be easier to open the lid of the hard-sided cooler box.

Figure 4A:
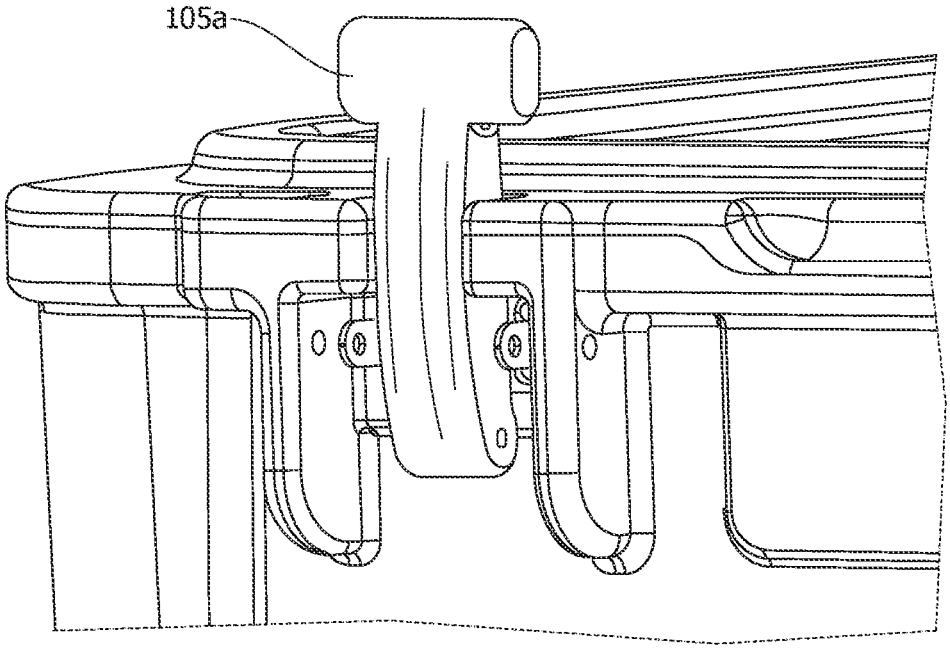
FIG. 4A depicts a front view of a latch on a hard-sided cooler with a one-sided opening lid in a closed position according to an embodiment of the present disclosure.
Figure 4B:
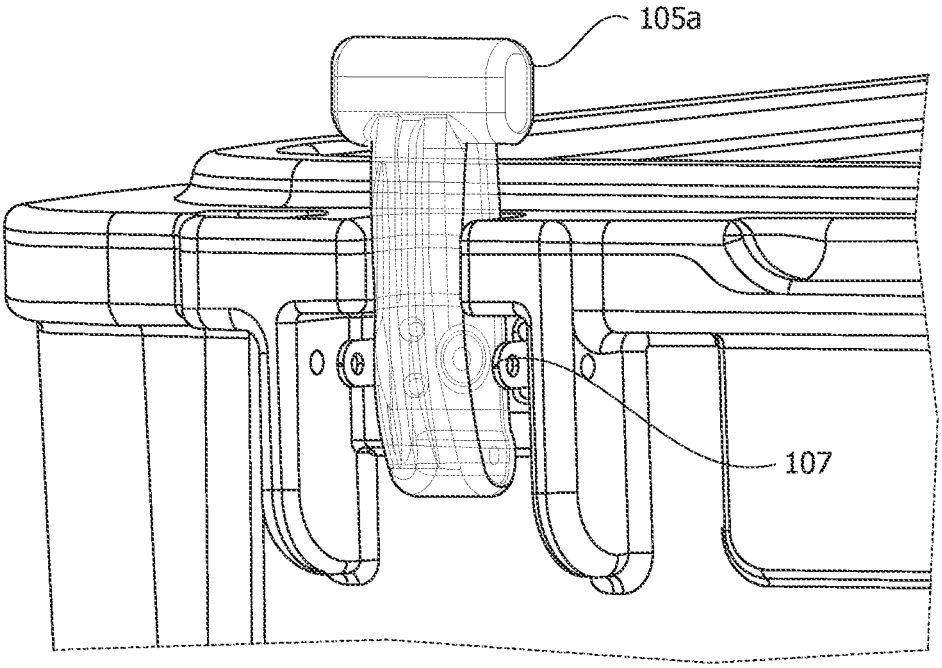
FIG. 4B depicts another front view of a latch presented in phantom on a hard-sided cooler with a one-sided opening lid in a closed position according to an embodiment of the present disclosure.

FIG. 4A depicts a front view of latch 105*a* on a hard-sided cooler box with a one-sided opening lid in a closed position according to an embodiment of the present disclosure, and FIG. 4B depicts another front view of a latch presented in phantom on a hard-sided cooler box with a one-sided opening lid in a closed position according to an embodiment of the present disclosure. As depicted in FIG. 4A, when latch 105*a* is in a closed position, channel or cylindrical-shaped hole 107 is blocked and not visible in this front view. When latch 105*a* is depicted in phantom (FIG. 4B), the blockage of channel or cylindrical-shaped hole 107 by latch 105*a* is in view.

Figure 4C:
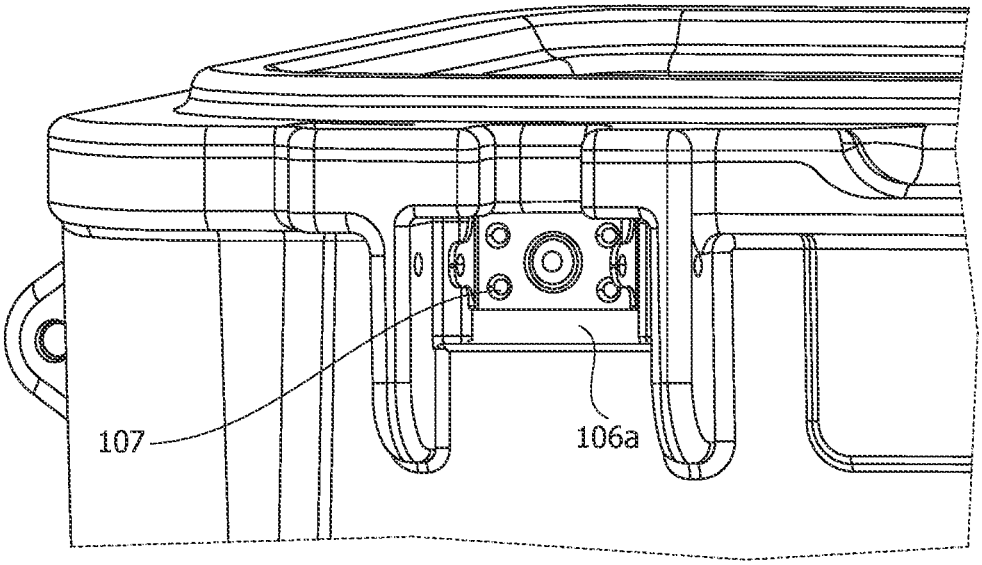
FIG. 4C depicts a front view of a channel on a front wall of a hard-sided cooler with a one-sided opening lid in a closed position according to an embodiment of the present disclosure.
Figure 4D:
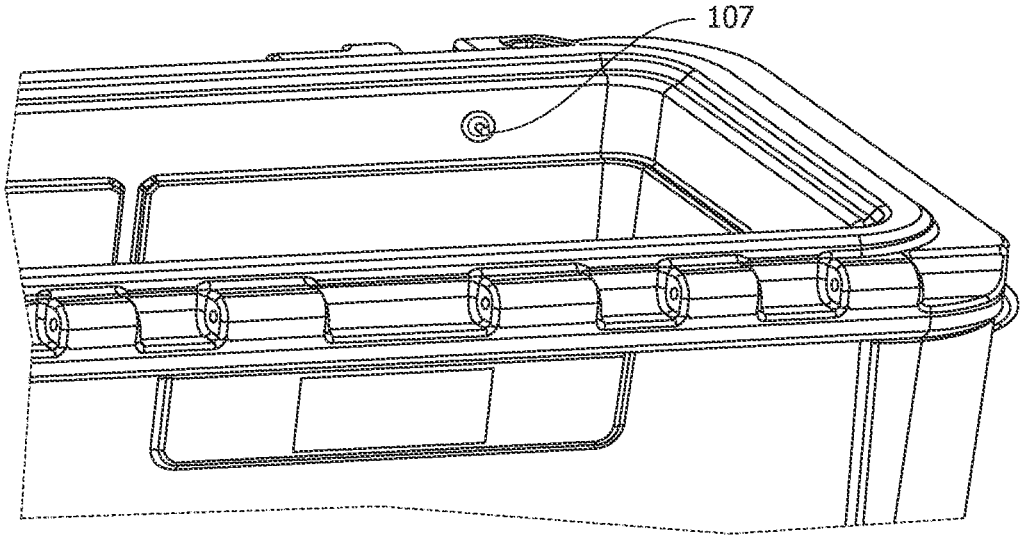
FIG. 4D depicts a front view of a channel on a back wall of a hard-sided cooler with a one-sided opening lid in an open position according to an embodiment of the present disclosure.

FIG. 4C depicts a front view of channel or cylindrical-shaped hole 107 on a front wall of a hard-sided cooler box with a one-sided opening lid in a closed position according to an embodiment of the present disclosure. In this view, the latch that may align with a receiver housing channel or cylindrical-shaped hole 107 has been removed so that channel or cylindrical-shaped hole 107 on the front wall of the hard-sided cooler box is visible. FIG. 4D depicts a front view of channel or cylindrical-shaped hole 107 on a back wall of a hard-sided cooler box with a one-sided opening lid in an open position according to an embodiment of the present disclosure. When the lid of the hard-sided cooler box is moved to a closed position, channel or cylindrical-shaped hole 107 on the back wall of the hard-sided cooler box may be blocked as well.

Figure 5A:
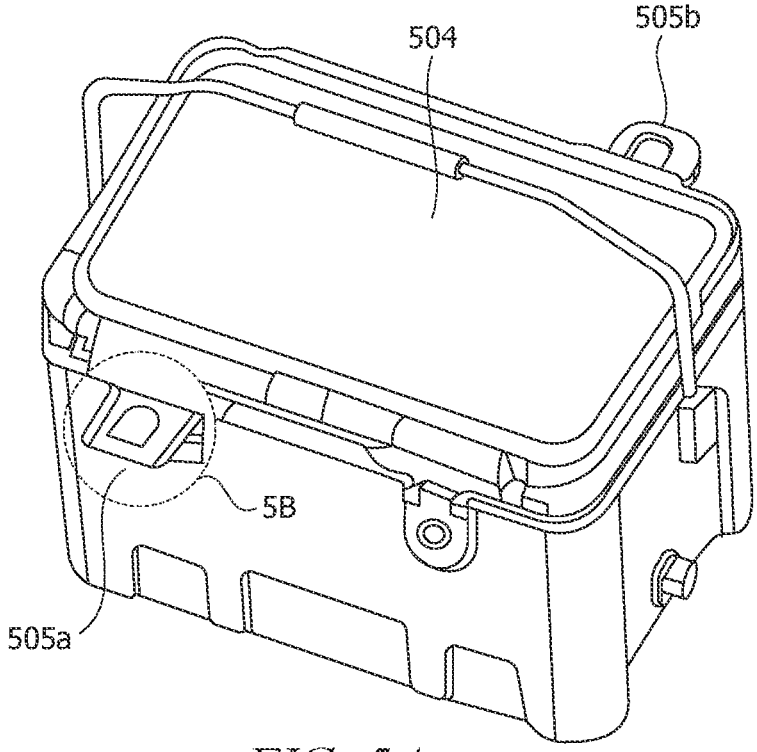
FIG. 5A depicts a top view of a hard-sided cooler in a closed configuration with a dual-sided opening lid according to an embodiment of the present disclosure.
Figure 5B:
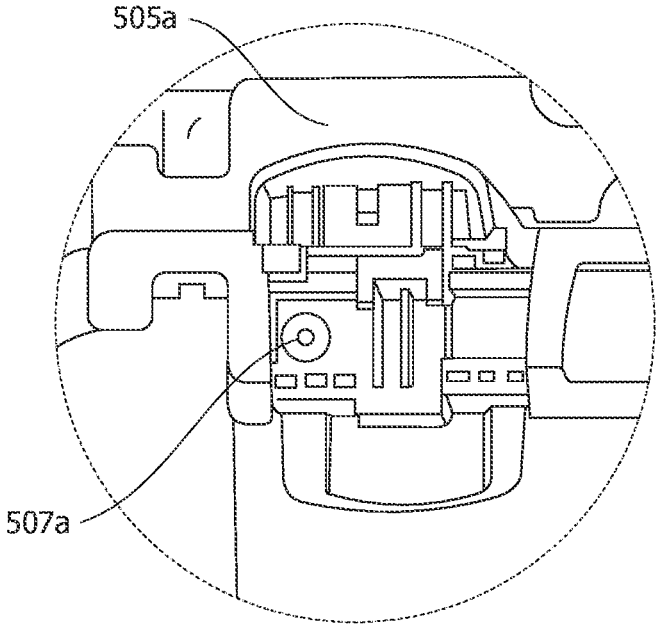
FIG. 5B depicts a close-up view of a latch on the hard-sided cooler of FIG. 5A in an open position according to an embodiment of the present disclosure.

As previously discussed, hard-sided cooler boxes according to embodiments of the present disclosure may include lids that may be one-sided opening lids or dual-sided opening lids. FIG. 5A depicts a top view of a hard-sided cooler box in a closed configuration with a dual-sided opening lid according to an embodiment of the present disclosure. Dual-sided opening lid 504 may include latches 505*a*, 505*b*. Latch 505*a* may attach to a front wall of the hard-sided cooler box, and latch 505*b* may attached to a back wall of the hard-sided cooler box. In this embodiment of the present disclosure, latches 505*a*, 505*b* each may include a channel or cylindrical-shaped hole (not depicted in FIG. 5A) that may be blocked from releasing air/pressure from the body of the hard-sided cooler when latches 505*a*, 505*b* are secured to the walls of the hard-sided cooler box. FIG. 5B depicts a close-up view of latch 505*a* on the hard-sided cooler box of FIG. 5A in an open position according to an embodiment of the present disclosure. In this embodiment, channel or cylindrical-shaped hole 507*a* on a front wall of the hard-sided cooler box is visible but would be blocked by latch 505*a* when it is secured to a receiver on the front wall of the hard-sided cooler box.

Figure 6A:
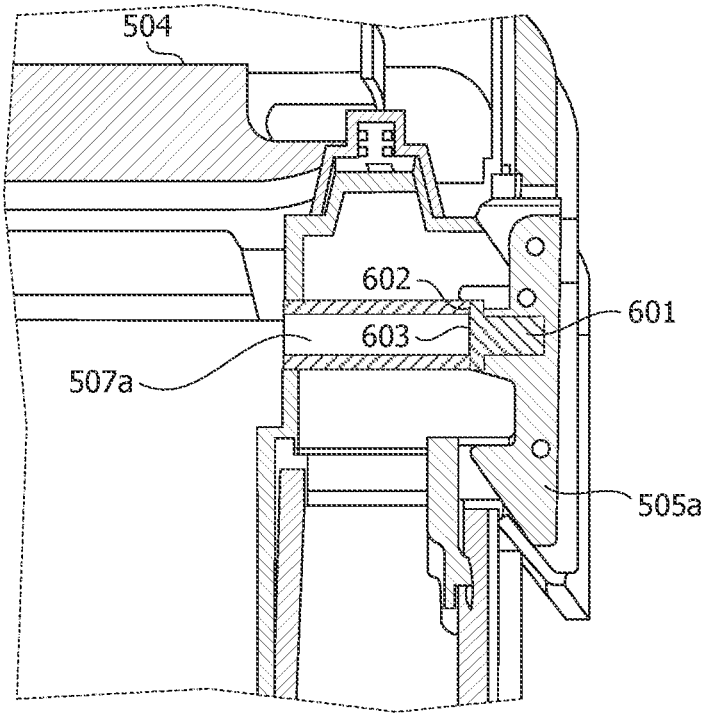
FIG. 6A depicts a side cross-sectional view of a latch in a closed position on a hard-sided cooler with a dual-sided opening lid according to an embodiment of the present disclosure.
Figure 6B:
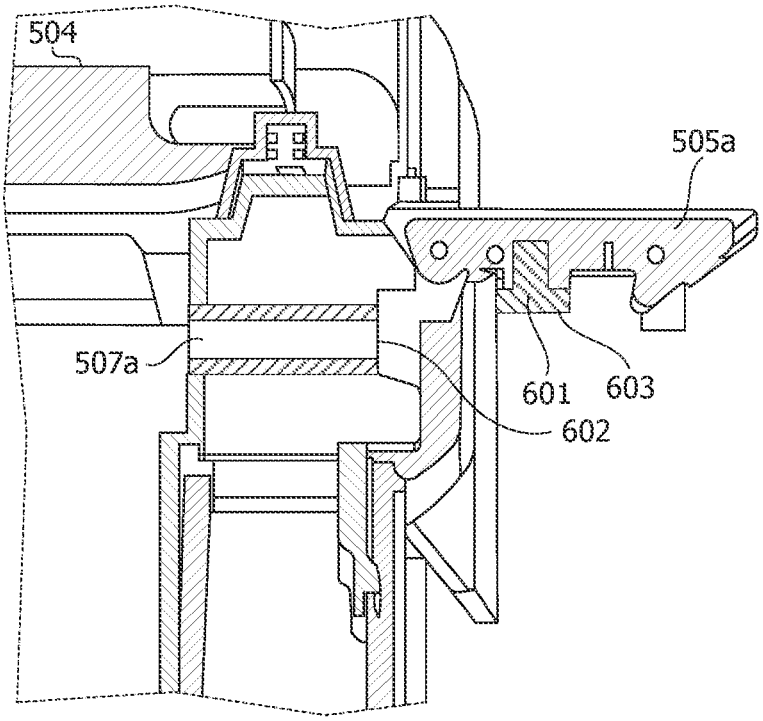
FIG. 6B depicts a side cross-sectional view of a latch in an open position on a hard-sided cooler with a dual-sided opening lid according to an embodiment of the present disclosure.

FIG. 6A depicts a side cross-sectional view of a latch 505*a* in a closed position on a hard-sided cooler box with a dual-sided opening lid according to an embodiment of the present disclosure. As depicted herein, the channel or cylindrical-shaped hole 507*a* on each of the front and back walls may be blocked by blocking member 601 of the latch 505*a* through the closure of the latches (such as latches 505*a*, 505*b*, FIG. 5A). The closure of the latches 505*a* and 505*b* would not affect the effectiveness of cooling of the hard-sided cooler box because the channel or cylindrical-shaped holes 507*a* on each of the front and back walls would not be open to external conditions since the channel or cylindrical-shaped hole 507*a* is blocked by blocking member 601. As can be seen, a flat surface 603 of the blocking member 601 directly covers the channel or cylindrical-shaped hole 507*a*. The blocking member 601 can be formed as a protrusion that blocks then end 602 of the channel or cylindrical-shaped hole 507*a*. The flat surface 603 of the blocking member 601 covers the end 602 of the channel or cylindrical-shaped hole 507*a*. FIG. 6B depicts a side cross-sectional view of a latch 505*a* in an open position on a hard-sided cooler box with a dual-sided opening lid 504 according to an embodiment of the present disclosure. When the latches 505*a* and 505*b* on the front and back walls of the hard-sided cooler box are opened, the channels or cylindrical-shaped holes 507*a* on each of the front and back walls may be open to external conditions, allowing vacuum pressure to be released from the interior of the hard-sided cooler box. This blocking and unblocking of the channels or cylindrical-shaped holes 507*a* may address the vacuum seal problem that arises with one-way gaskets, as previously described, for example, with respect to FIG. 3B.

Figure 7A:
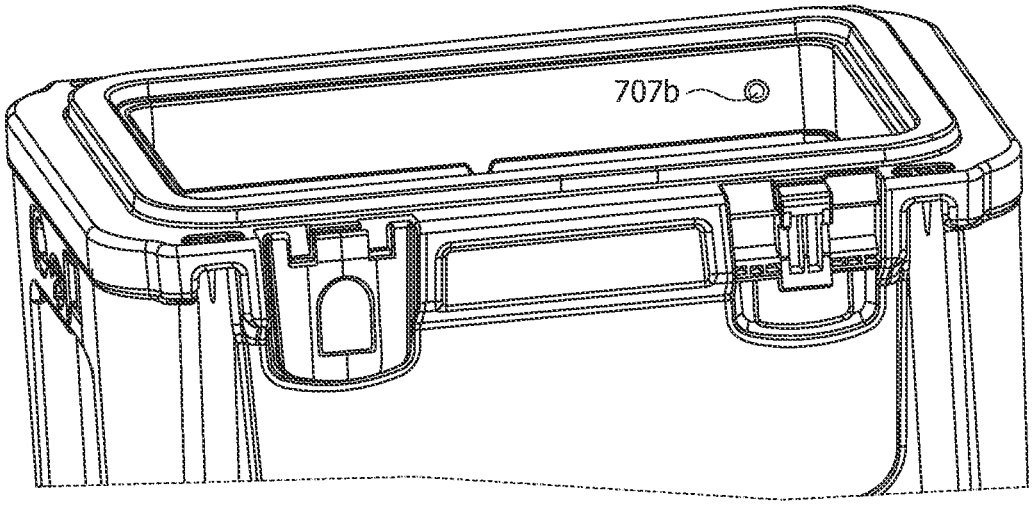
FIGS. 7A-7D depict various views of latches on a hard-sided cooler with a dual-sided opening lid according to an embodiment of the present disclosure.
Figure 7B:
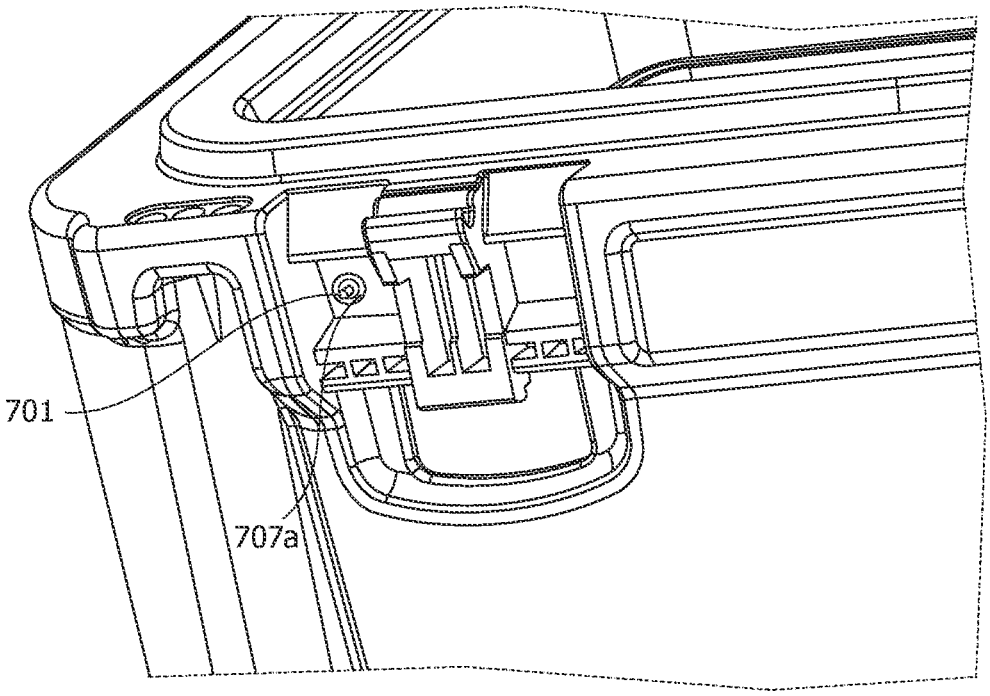
Figure 7C:
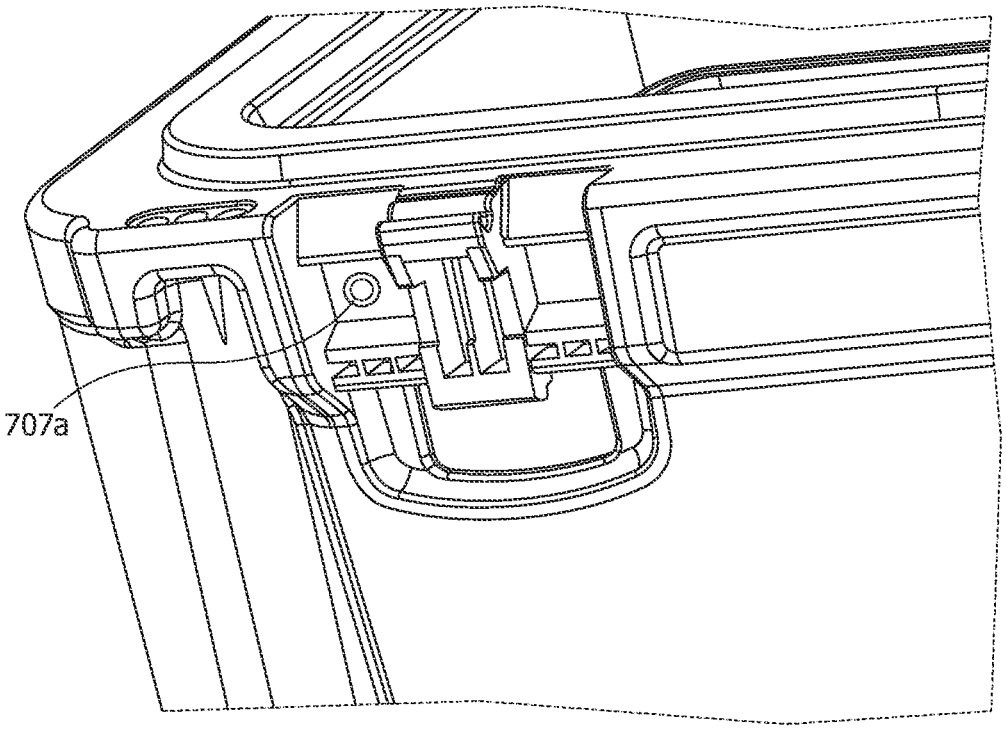
Figure 7D:
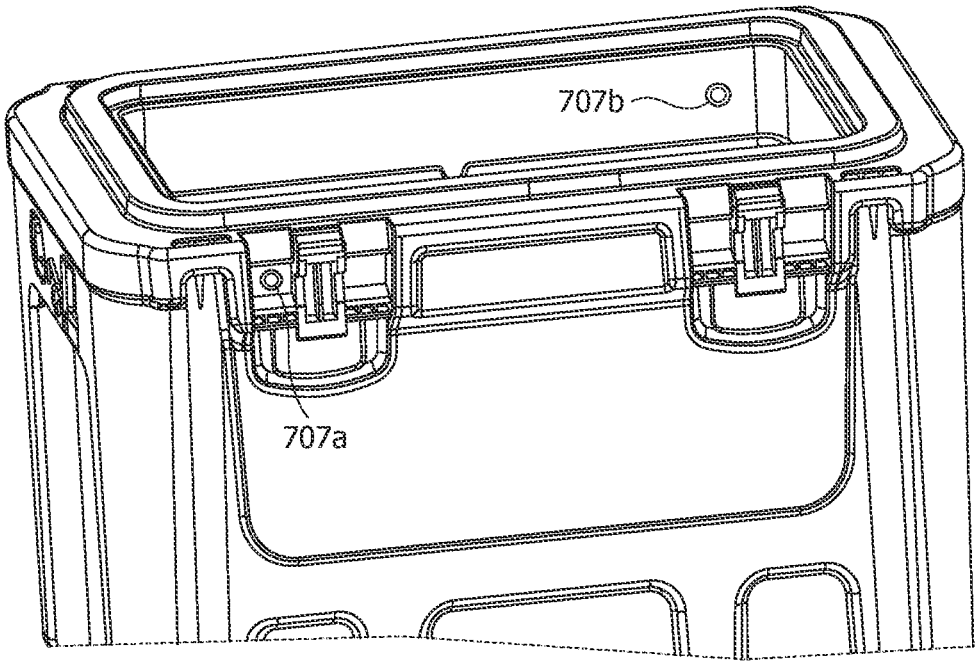

FIGS. 7A-7D depict various views of latches on a hard-sided cooler box without a dual-sided opening lid for illustrative purposes. More specifically, FIG. 7A depicts a view of the hard-sided cooler box (without the lid for illustrative purposes) where the channel or cylindrical-shaped hole 707*b* on the back wall is visible from the interior of the cooler body. FIG. 7B depicts one of the receivers on the front wall without the latch covering the receiver, to illustrate a blocking member 601 placed over a channel 707*a*. In operation, the blocking member 601 would be operatively connected to a latch, such as latch 505*a* in FIGS. 6A and 6B. FIGS. 7C and 7D depict views of the front wall of the hard-sided cooler box without the latches and lid, so that the channel or cylindrical-shaped holes 707*a* and 707*b* are visible.

It should be appreciated that although the hard-sided cooler box according to embodiments of the present disclosure is illustrated with the latches being manipulated in a generally downward direction to engage the receivers, embodiments of the present disclosure include the inverse as well. Additionally, although embodiments of the present disclosure may depict a hard-sided cooler box with two latches on a front wall in a one-sided lid opening configuration and two latches on the front and back walls in a dual-sided lid opening configuration, it should be appreciated that the lid may be secured to the body of the hard-sided cooler box with only one latch on a front wall or a back wall without departing from the present disclosure. In such embodiments, for example, in a one-sided lid opening configuration, the latch on a front wall of the hard-sided cooler box may be received by a centrally located receiver having a channel or cylindrical-shaped hole. The latch may cover the channel or cylindrical-shaped hole and fasten the lid to the body of the hard-sided cooler box. There also may be embodiments of the present disclosure where the positioning of the latches, and accordingly the channel(s) or cylindrical-shaped hole(s) may change, such as if the latches affix to the side walls of the hard-sided cooler box. Further, although embodiments of the present disclosure may depict the latches being received by receivers, it should be appreciated that the receivers may assume different forms, such as slots to receive the latches, without departing from the present disclosure.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A hard-sided cooler box comprising:

a body formed of a bottom, a front wall parallel to a back wall, a first side wall parallel to a second side wall, the front wall, the back wall, the first side wall, and the second side wall extending from the bottom to delineate the body of the hard-sided cooler box;

a liner positioned inside the body;

an insulating foam positioned between the body and the liner;

a lid coupled to an opening of the body opposite the bottom of the body, the lid movable between an open position and a closed position;

a gasket positioned between the lid and the body when the lid is in the closed position;

at least one receiver positioned on an outer portion of the front wall, the at least one receiver having a channel that extends from the outer portion of the front wall through the body, the insulating foam, and the liner of the hard-sided cooler box to an inner portion of the liner, the channel having an outer end surface portion in direct and intimate abutment with an inner surface of an opening through the outer portion of the body, a middle portion extending through the insulating foam, an inner surface portion in direct and intimate abutment with an inner surface of an opening through the inner portion of the liner;

at least one latch securable to the at least one receiver, wherein the at least one latch comprises a blocking member that directly covers the channel when the lid is in the closed position and when the at least one latch is secured and in a closed position, and wherein the channel is unblocked to release a pressure or a vacuum from the body of the hard-sided cooler box when the at least one latch is unsecured.

2. The hard-sided cooler box of claim 1, wherein the lid is a one-sided opening lid.

3. The hard-sided cooler box of claim 1, wherein the lid is a dual-sided opening lid.

4. The hard-sided cooler box of claim 3, the at least one latch comprising:

a first latch securable to a first receiver positioned on the outer portion of the front wall; and a second latch securable to a second receiver positioned on an outer portion of the back wall, wherein the first receiver houses a first channel covered by the first latch and the second receiver houses a second channel covered by the second latch when the lid is in the closed position and when the first latch and the second latch are, respectively, secured, and wherein each of the first and second channels will be, respectively, unblocked to release pressure or vacuum from the hard-sided cooler box when, respectively, the first latch or the second latch is, respectively, unsecured.

5. The hard-sided cooler box of claim 1, wherein the at least one latch provides a smooth, flat surface that connects flush with the at least one receiver.

6. The hard-sided cooler box of claim 1, wherein when the at least one latch is secured to the at least one receiver, a seal is created, and when the at least one latch is released, air or vacuum contained within the body is released through the channel.

7. The hard-sided cooler box of claim 1 further comprising:

at least one additional latch that is securable to the front wall of the hard-sided cooler box but does not cover the channel.

8. The hard-sided cooler box of claim 1, wherein the blocking member has a flat surface that directly covers the channel when the lid is in the closed position and when the at least one latch is secured and in the closed position.

9. The hard-sided cooler box of claim 8, wherein the flat surface directly covers an end of the channel.

10. The hard-sided cooler box of claim 1, wherein the blocking member directly covers an end of the channel.

11. A hard-sided cooler box comprising:

a body formed of a bottom, a front wall parallel to a back wall, a first side wall parallel to a second side wall, the front wall, the back wall, the first side wall, and the second side wall extending from the bottom to delineate the body of the hard-sided cooler box;

a liner positioned inside the body;

an insulating foam positioned between the body and the liner;

a dual-sided opening lid coupled to an opening of the body opposite the bottom of the body, the lid movable between an open position and a closed position;

a gasket positioned between the lid and the body when the lid is in the closed position;

a first latch securable to a first receiver positioned on an outer portion of the front wall; and a second latch securable to a second receiver positioned on an outer portion of the back wall, wherein the first receiver houses a first channel that is directly covered by a first blocking member of the first latch when the first latch is secured, wherein the second receiver houses a second channel that is directly covered by a second blocking member of the second latch when the second latch is secured, wherein each of the first channel and the second channel is, respectively, unblocked to release a vacuum or pressure from the body of the hard-sided cooler box when, respectively, the first latch or the second latch is, respectively, unsecured, and wherein each of the first and second channels extends from an outer portion of the front wall through the body, the insulation foam, and the liner of the hard-sided cooler box to an inner portion of the liner, each of the first and second channels having an outer end surface portion in direct and intimate abutment with an inner surface of an opening through the outer portion of the body, a middle portion extending through the insulating foam, an inner surface portion in direct and intimate abutment with an inner surface of an opening through the inner portion of the liner.

12. The hard-sided cooler box of claim 11, wherein the first latch and the second latch are unsecured to release vacuum or pressure from the body via the first and second channels on the first receiver and the second receiver.

13. The hard-sided cooler box of claim 11, wherein the first latch and the second latch each provides a smooth, flat surface that connects flush with the first receiver and the second receiver, respectively.

14. The hard-sided cooler box of claim 11, wherein when the first latch and the second latch are secured to the first receiver and the second receiver, respectively, a seal is created between the first channel and the first blocking member and between the second channel and the second blocking member, and when the at least the first latch or the second latch is released, a vacuum or pressure contained within the body is released through the first channel or the second channel.

15. The hard-sided cooler box of claim 11 further comprising:

at least one additional latch that is securable to the front wall of the hard-sided cooler box but does not cover a channel.

16. The hard-sided cooler box of claim 11, wherein the first latch and the second latch are attached to the lid when unsecured.

17. The hard-sided cooler box of claim 11, wherein the first latch and the second latch are attached to the front wall and the back wall of the hard-sided cooler box when unsecured.

18. A hard-sided cooler box comprising:

a body formed of a bottom, a front wall parallel to a back wall, a first side wall parallel to a second side wall, the front wall, the back wall, the first side wall, and the second side wall extending from the bottom to delineate the body of the hard-sided cooler box;

a liner positioned inside the body;

an insulating foam positioned between the body and the liner;

a lid coupled to an opening of the body opposite the bottom of the body, the lid movable between an open position and a closed position;

a gasket positioned between the lid and the body when the lid is in the closed position;

a first receiver positioned on an outer portion of the front wall, the first receiver having a channel that extends from the outer portion of the front wall through the body, the insulating foam, and the liner of the hard-sided cooler box to an inner portion of the liner, the channel having an outer end surface portion in direct and intimate abutment with an inner surface of an opening through the outer portion of the body, a middle portion extending through the insulating foam, an inner surface portion in direct and intimate abutment with an inner surface of an opening through the inner portion of the liner;

a first latch securable to the first receiver, wherein a blocking member of the first latch directly covers an opening in the channel when the lid is in the closed position and when the first latch is secured and in a closed position, and wherein the channel is unblocked to release vacuum or pressure from the body of the hard-sided cooler box when the first latch is unsecured.

19. The hard-sided cooler box of claim 18, further comprising:

a second latch securable to a second receiver not including a channel.

20. The hard-sided cooler box of claim 18, wherein the first latch provides a smooth, flat surface that connects flush with the first receiver.

* * * * *